US005762463A

United States Patent [19]

Bielagus

[11] Patent Number: 5,762,463

[45] Date of Patent: Jun. 9, 1998

[54] PIVOT WHEEL BAG OPENER

[75] Inventor: Joseph B. Bielagus, Tualatin, Oreg.

[73] Assignee: Beloit Technologies, Inc., Wilmington, Del.

[21] Appl. No.: 751,074

[22] Filed: Nov. 15, 1996

[51] Int. Cl.[6] ..... B65B 69/00

[52] U.S. Cl. ..... 414/412; 241/186.35; 241/DIG. 38

[58] Field of Search ..... 414/412; 241/186.35, 241/280, DIG. 38; 198/853

[56] References Cited

U.S. PATENT DOCUMENTS

| | | | |
|---|---|---|---|
| 3,891,105 | 6/1975 | Cerroni | 414/412 |
| 4,067,506 | 1/1978 | Cerroni | 241/200 |
| 4,155,444 | 5/1979 | Kovats | 198/853 X |
| 5,163,627 | 11/1992 | Bouche | 414/412 X |
| 5,188,500 | 2/1993 | Eide et al. | 414/412 |
| 5,328,016 | 7/1994 | Leifeld et al. | 414/412 X |
| 5,352,082 | 10/1994 | Bennison | 414/412 |
| 5,415,515 | 5/1995 | Bielagus et al. | 414/412 |
| 5,419,498 | 5/1995 | Rasmussen et al. | 241/280 X |
| 5,484,238 | 1/1996 | Bielagus | 414/412 |
| 5,505,391 | 4/1996 | Krueger et al. | 241/186.35 X |
| 5,551,825 | 9/1996 | Montgomery | 414/412 |

FOREIGN PATENT DOCUMENTS

| | | | |
|---|---|---|---|
| 0 713 831 | 5/1996 | European Pat. Off. . | |
| 1 297 550 | 6/1969 | Germany . | |
| 93 15 282 | 12/1993 | Germany . | |
| 111644 | 4/1989 | Japan | 414/412 |
| 8303265 | 4/1985 | Netherlands . | |
| 628035 | 9/1978 | U.S.S.R. . | |
| 772930 | 10/1980 | U.S.S.R. | 414/412 |
| 825379 | 4/1981 | U.S.S.R. . | |
| 1013-356-A | 4/1983 | U.S.S.R. . | |
| 1244033 | 7/1986 | U.S.S.R. | 414/412 |
| 860028 | 2/1961 | United Kingdom | 414/412 |

*Primary Examiner*—David A. Bucci
*Attorney, Agent, or Firm*—Lathrop & Clark

[57] ABSTRACT

A bag breaking apparatus has an apron feeder type conveyor with an apron constructed of over-lapping pans. Thin upstanding triangular teeth are mounted to each pan parallel to the direction of motion of the conveyor. Bags of trash are supplied to the conveyor and progress to an outfeed end. A roll is positioned over the conveyor near the outfeed end. The roll is driven about the axis of the roll. Triangular teeth mounted to the roll interdigitate with the teeth on the conveyor thus rending the bags which pass between the roll and the conveyor. The roll can be raised and lowered to accommodate bags of different sizes and is pivotable to swing upwardly when faced with oversize or excessive amounts of trash and thereby allow the material causing the jam to pass under the roll and off the outfeed end of the conveyor.

18 Claims, 2 Drawing Sheets

PIVOT WHEEL BAG OPENER

FIELD OF THE INVENTION

The present invention relates to bag breakers and bag openers in general, and more particularly to an apparatus for opening garbage bags.

BACKGROUND OF THE INVENTION

Municipal refuse is often placed in plastic garbage bags for disposal. Such bags are often used by consumers who find the use of garbage cans undesirable. Garbage cans are often insufficiently well sealed to prevent odors arising from the trash from becoming objectionable. Trash cans often become soiled and are thus a continuous source of noxious odors. Further, residuals attached to garbage cans can be a source of attraction of insects such as ants. For many businesses, trash bags cut down on the labor necessary in handling the trash, particularly in the need to retrieve, clean, and store trash cans after the trash contained therein has been collected. Empty trash cans have the potential to be blown about by high winds when empty. When full, trash cans can be tipped over, releasing garbage and trash to cause litter and require considerable employee time to clean up.

In some circumstances, municipal plans for recycling require that certain types of recyclable material, such as aluminum cans, plastic bottles and glass bottles, be placed in clear plastic bags for identification and collection.

Because the premature breaking of a garbage bag is highly undesirable, resulting in the complete failure of the bag's intended purpose, garbage bags are designed to resist punctures and when punctured, to resist tearing so that a sharp item contained within a trash bag, while puncturing the bag, does not result in the release of the bag's contents.

This property of trash bags to resist tearing was not a problem when municipal trash was simply landfilled. However, with increasing desirability and requirements for recycling, it is often necessary to open the trash bags so that is their contents may be separated for recycling.

In the past, bag openers have been designed to handle industrial commodities which are normally shipped in bags. Cement, sand, and clay for example are often sold and shipped in bags. Bag openers designed for industrial commodities typically hit or shear the bags, which are not as tear-resistant as municipal trash bags. Because the commodity-like cement or sand are not easily damaged by breaking or further comminution, the design of bag openers for industrial commodities may employ techniques which are unsuitable for opening municipal garbage bags. In opening municipal garbage bags, it is desirable to avoid breaking the contents of the bag into smaller pieces as that further complicates separating the garbage into its various constituents.

Often bags breakers are fed a stream of municipal waste directly from dumpsters and occasionally a large object such as an engine block finds its way into the bag breaker. Such a large object will typically cause a jam which may damage the bag breaker and will require considerable down-time while the machine is cleared. Another problem with some bag breaking apparatus is the tines which break the bags can become excessively entangled with empty plastic bags.

What is needed is a bag breaker which is not easily jammed or overloaded and which resists a buildup of plastic bags on the bag breaking structure.

SUMMARY OF THE INVENTION

The bag breaking apparatus of the present invention employs a conveyor of the apron feeder type which utilizes a belt or apron constructed of over-lapping metal pans. The apron passes endlessly around two shafts which support sprocket wheels. One of the shafts is driven by a motor through a speed reducer. Intermediate support wheels support the upper surface of the apron on which trash bags are loaded. Thin upstanding triangular teeth are mounted to each pan parallel to the direction of motion of the conveyor. Bags of trash are supplied by an infeed chute to the infeed end of the conveyor and progress to an outfeed end. A roll is positioned over the conveyor near the outfeed end. The roll has a cylindrical surface and is driven about the axis of the roll. Triangular teeth mounted to the cylindrical surface interdigitate with the teeth on the conveyor thus rending the bags which pass between the roll and the conveyor. The roll can be raised and lowered to accommodate bags of different size. The roll is also pivotally mounted such that if a large object or too much trash become jammed between the roll and the conveyor upper surface the roll can pivot away from the conveyor allowing the material causing the jam to pass under the roll and off the outfeed end of the conveyor.

It is a feature of the present invention to provide a garbage bag breaker which is less subject to jamming.

It is another feature of the present invention to provide a garbage bag breaker which minimizes machine down time.

It is a further feature of the present invention to provide a garbage bag breaker which minimizes bag entanglement with the bag breaking structure.

Further objects, features and advantages of the invention will be apparent from the following detailed description when taken in conjunction with the accompanying drawings.

DESCRIPTION OF THE PREFERRED EMBODIMENT

Figure 1:
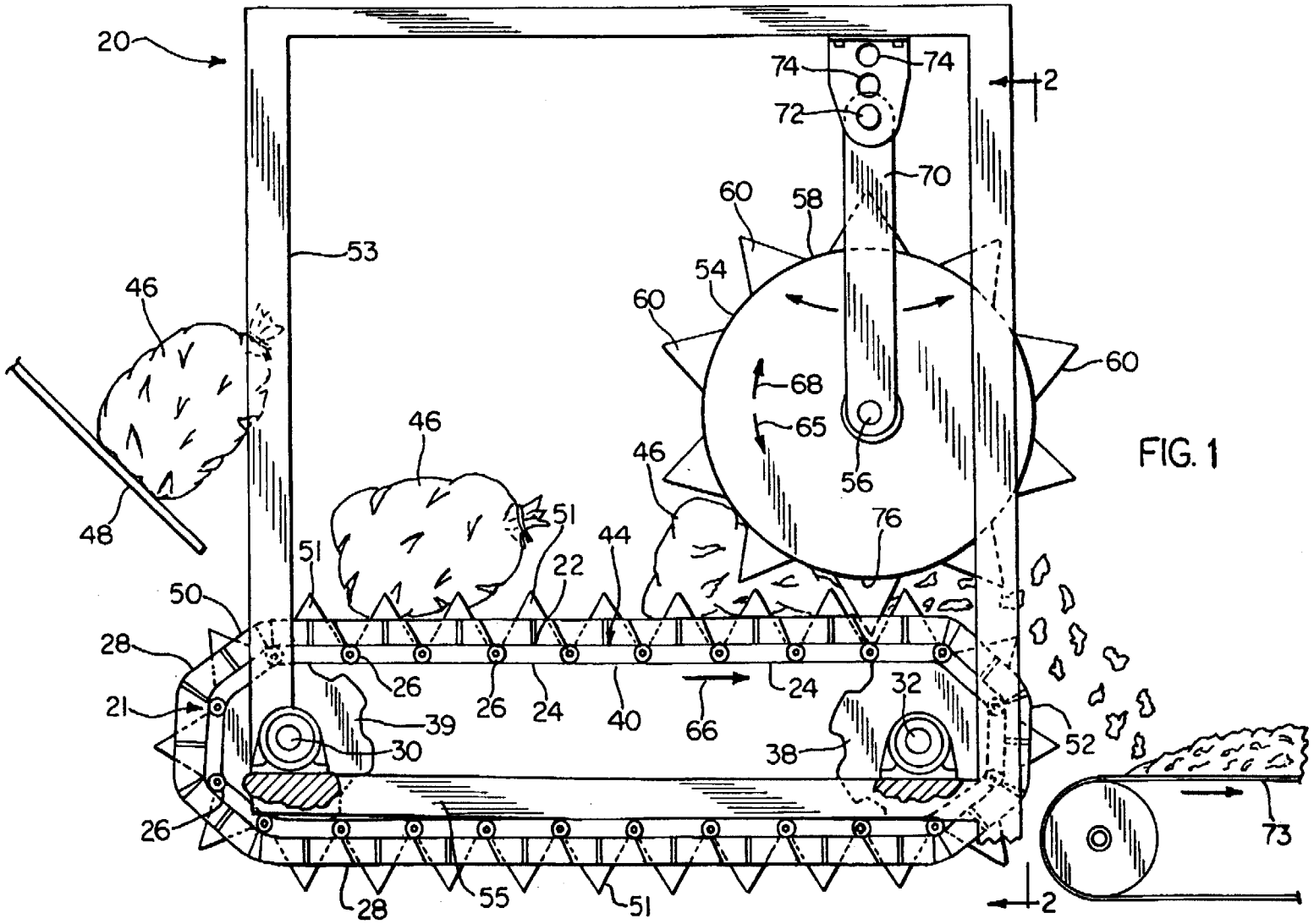
FIG. 1 is a side elevational view partly cut-away of the bag breaker of this invention.
Figure 2:
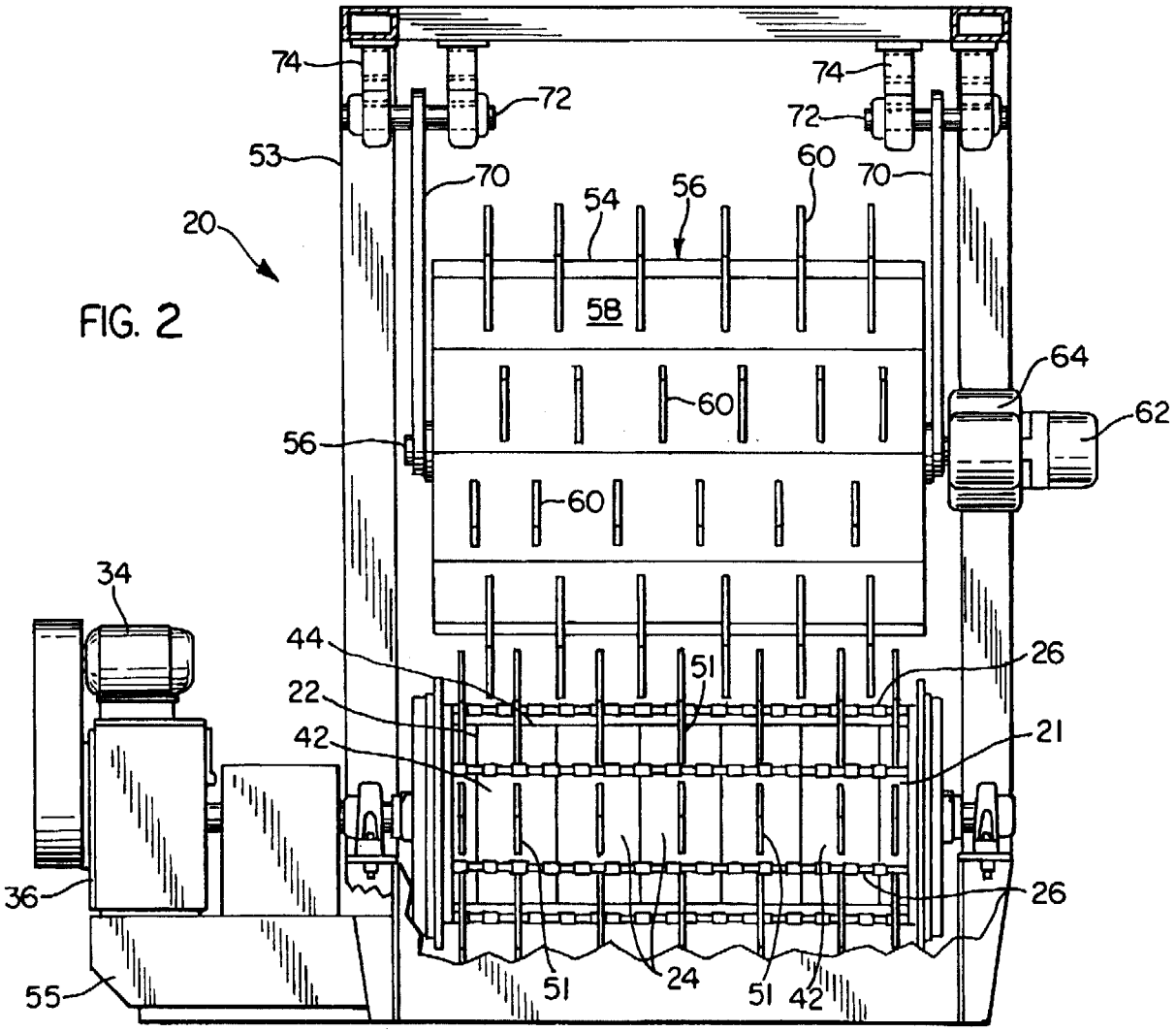
FIG. 2 is a front elevational view of the bag breaker of FIG. 1 taken along line 2—2.

Referring more particularly to FIGS. 1–2 wherein like numbers refer to similar parts, a bag breaker 20 of this invention has a conveyor 21 with an endless apron 22 constructed of overlapping pans 24. The pans 24 are connected by hinges 26 and have overlapping upstanding edges 28. The apron 22 travels between two shafts 30, 32, one of which is driven by a motor 34 through a speed reducer 36. Sprocket drive wheels 38 mounted to the driven shaft 32 drive the apron 22 about an endless path. An idler sprocket 39 on the idler shaft 30 supports the apron 22. Idler support wheels (not shown) underlie and support the upper portion 40 of the apron 22 which passes over the top of the sprocket wheels 38, 39. Conveyors of this type are available from a number of industry suppliers, including Webster Chain.

The pans 24 have outwardly facing surfaces 42 which on the upper portion 40 of the apron 22 form a conveying surface 44. The conveying surface 44 moves trash bags 46 supplied by an infeed chute 48 from an infeed end 50 to an outfeed end 52. Triangular teeth 51 are welded to the outwardly facing surfaces 42 of the pans 24. The teeth 51 are thin upstanding plates and are aligned with the direction of motion of the apron 22. The teeth 51 puncture the bags 46 and hold them in place on the apron 22.

A roll 54 which rotates about a shaft 56 is pivotally mounted adjacent the outfeed end 52 of the conveyor 21. The roll 54 is pivotally mounted to a frame 53 which extends from the conveyor frame 55.

The shaft 56 on which the roll 54 is mounted defines an axis of rotation about which the roll 54 turns. The roll has a cylindrical surface 58 on which are welded radially extending triangular teeth 60. The teeth 60 on the roll interdigitate with or pass between the teeth 51 on the conveyor 21. The teeth 60 may be staggered so that the spaces between the roll teeth 60 and the conveyor teeth 51 vary as the roll 54 turns. The varying distance between the teeth improves bag opening performance and facilitates removing objects impaled on the teeth.

The roll teeth 60 are driven by a motor 62 through a speed reducer 64 which causes the roll 54 to turn about the axis defined by the shaft 56. The direction of roll 54 rotation, shown by arrow 66, may be the same as the direction of conveyor 21 advancement, shown by arrow 66. The roll 54 motion is slower then the motion of the conveyor so the teeth 51, 60 move past each other and rip the bags 46 open. Alternatively the roll 56 may be driven in a direction opposite to the motion of the conveyor, as indicated by arrow 68.

As the teeth 60, 51 pass by each other they rend and tear open the bags 46. The trash and shredded bags are transported to the outfeed end 52 of the conveyor 21 and deposited on a conveyor 73 for further processing. The triangular shape of the teeth resists a buildup of plastic bags on the teeth. The increasing width in the machine direction of the triangular teeth 51, 60 as they approach the surface on which they are mounted means the teeth are less likely to deeply impale the plastic of the bags 46. Moreover, the wedge shape of the teeth insures that any bags which are impaled on the teeth come loose easily.

The shaft 56 on which the roll 54 is mounted is suspended between opposed links 70 which suspend the roll from an overhead pivot bearing 72. The overhead pivot bearing 72 has multiple positions 74 which allow the roll 56 to be raised and lowered with respect to the conveying surface 44.

When the roll 54 is driven in the opposite direction as the conveyor 21, care must be taken so that the roll 54 is not carried forward of its free hanging point 76. For this reason a stop (not shown) can be position to prevent the roll 54 from moving forward of the free hanging point 76. An advantageous feature of the bag breaker 20 is that it allows the gap between the roll 54 and the apron 21 to increase if an obstructing object or an accumulation of trash begins to become jammed between the roll 54 and the conveyor apron 21. If the roll were to move closer to the apron as a jam begins to form the jamming action could intensify, thereby producing an actual obstructing jam. On the contrary, in the device 20, the forces on the roll cause it to swing towards the outfeed end 52 of the conveyor 21. The forces on the roll 54 are produced by the steady stream of trash moving under the roll 54. The curve of the of the roll 54 produces a wide throat into which the trash 46 moves. The wide throat and the ability of the roll to swing backwards towards the outfeed and 52 of the conveyor prevents jamming of the bag breaker 20.

Additionally, if the roll 54 is rotated in a direction opposite that of the conveyor 20, the teeth 60 serve to spread out and level out the trash on the conveyor 20. Trash is typically supplied to the conveyor 20 from dumpsters or trash trucks, and the nature of trash is such that it often clumps together. This clumping leads to jams in many conventional machines which consequently require leveling of the trash before it is fed to the bag breaker. The bag breaker 20 of this invention may require little or no leveling of the incoming trash thus reducing the amount of equipment required to process bagged trash.

It should be understood that various mechanisms for raising and lowering the roll 54 could be used. For instance the over head pivot bearing 72 could be mounted to a screw jack or hydraulic piston arrangement which would 72 could be mounted to a screw jack or hydraulic piston arrangement which would facilitate rapid changes in the clearance between the conveying surface and the roll 54.

It should be understood that while the conveyor for moving the trash under the roll will preferably be of the apron feeder type, other conveyors could be used, including conveyors of the type employing a continuous belt such as is conventionally fabricated of fiber reinforced rubber or plastic. The conveyor could also be of the drag chain type such as commonly used in the log handling industry.

It is understood that the invention is not limited to the particular construction and arrangement of parts herein illustrated and described, but embraces such modified forms thereof as come within the scope of the following claims.

I claim:

1. An apparatus for opening garbage bags to discharge refuse contained therein, the apparatus comprising:

a conveyor having a unitary conveying surface having mounted thereon at least three rows of upstanding teeth arrayed in the cross-machine direction, where each row comprises a multiplicity of upstanding teeth, and wherein bags to be opened are received on the conveying surface and advanced thereon;

a motor mounted in driving relation to the conveyor to cause the surface of the conveyor to move in a first direction;

a substantially circular roll having an axis of rotation and being positioned above the conveying surface, the roll being pivotally mounted to pivot parallel to the direction of motion of the conveying surface, the roll having a substantially cylindrical surface with a multiplicity of radially extending teeth mounted thereon; and a second motor mounted in driving relation to the roll to cause the roll to rotate about the roll axis of rotation, the roll teeth engaging bags conveyed on the conveying surface for opening thereof.

2. The apparatus of claim 1 wherein the conveyor defines an infeed end and an outfeed end, and further comprising a trash supply chute positioned to supply the conveyor infeed end with trash bags to be opened; and wherein the roll is positioned adjacent to the conveyor outfeed, the roll pivotal mounting allowing the roll to pivot away from the conveying surface in the direction of the outfeed so that if an excessive amount of trash is placed on the conveying surface the roll can pivot to allow the trash to progress to the outfeed end without becoming jammed between the roll and the conveyor.

3. The apparatus of claim 1 wherein the teeth on the conveyor and the roll interdigitate, thus facilitating rending of plastic garbage bags.

4. The apparatus of claim 1 wherein the teeth have a generally triangular shape.

5. The apparatus of claim 1 wherein the pivotal mount provides for adjusting the height of the roll over the conveying surface.

6. The apparatus of claim 1 further comprising a frame joining the conveyor to the pivotal mount which supports the roll.

7. The apparatus of claim 1 wherein the conveyor is of the apron feeder type consisting of an endless apron of overlapping pans, the teeth being mounted to the pans.

8. The apparatus of claim 7 wherein the pans have overlapping upstanding sides.

9. The apparatus of claim 1 wherein the roll is driven to rotate about the roll axis in the same direction as the conveying surface is driven but at a slower speed so the teeth on the conveying surface move past the teeth on the roll.

10. The apparatus of claim 1 wherein the roll is driven to rotate about the roll axis in the opposite direction as the conveying surface so the teeth on the conveying surface move past the teeth on the roll.

11. An apparatus for opening garbage bags to discharge refuse contained therein, the apparatus comprising:

a conveyor of the apron feeder type consisting of an endless apron of overlapping pans forming a unitary conveying surface, wherein at least three rows of upstanding teeth arrayed in the cross-machine direction are mounted to the pans, each row comprising a multiplicity of upstanding teeth, and wherein the conveyor has an infeed end and an outfeed end;

a motor mounted in driving relation to the conveyor to cause the surface of the conveyor to move in a first direction;

a substantially circular roll positioned adjacent to the conveyor outfeed end, the roll having an axis of rotation and being positioned above the conveying surface, the roll being mounted to pivot about an axis above and parallel to the roll axis, wherein the roll has a cylindrical surface with a multiplicity of radially extending teeth mounted thereon; and a second motor mounted in driving relation to the roll to cause the roll to rotate about the roll axis of rotation, wherein the roll pivotal mounting allows the roll to pivot away from the conveying surface in the direction of the outfeed so that if an excessive amount of trash is placed on the conveying surface the roll can pivot to allow the trash to progress to the outfeed without becoming jammed between the roll and the conveyor.

12. The apparatus of claim 11 wherein the teeth on the conveyor and the roll interdigitate thus facilitating rending plastic garbage bags.

13. The apparatus of claim 11 wherein the teeth have a generally triangular shape.

14. The apparatus of claim 11 wherein the pivotal mount provides for adjusting the height of the roll over the conveying surface.

15. The apparatus of claim 11 further comprising a frame joining the conveyor to the pivotal mount which supports the roll.

16. The apparatus of claim 11 wherein the pans have overlapping upstanding sides.

17. The apparatus of claim 11 wherein the roll is driven to rotate about the roll axis in the same direction as the conveying surface is driven but at a slower speed so the teeth on the conveying surface move past the teeth on the roll.

18. The apparatus of claim 11 wherein the roll is driven to rotate about the roll axis in the opposite direction as the conveying surface so the teeth on the conveying surface move past the teeth on the roll.

* * * * *